US007117536B2

(12) United States Patent
Burnett et al.

(10) Patent No.: US 7,117,536 B2
(45) Date of Patent: Oct. 10, 2006

(54) SILICONE GRABBER

(75) Inventors: David L. Burnett, New York, NY (US); William J. Lazaroff, Floral Park, NY (US)

(73) Assignee: Lifetime Hoan Corporation, Westbury, NY (US)

( * ) Notice: Subject to any disclaimer, the term of this patent is extended or adjusted under 35 U.S.C. 154(b) by 264 days.

(21) Appl. No.: 10/718,080

(22) Filed: Nov. 20, 2003

(65) Prior Publication Data

US 2005/0108802 A1 May 26, 2005

(51) Int. Cl.
*A41D 13/08* (2006.01)

(52) U.S. Cl. ..... 2/16; 2/161.6

(58) Field of Classification Search ..... 2/16, 2/20, 21, 160, 161.6, 158; 16/DIG. 12; 15/227; 294/25, 902; 7/110; 81/3.4
See application file for complete search history.

(56) References Cited

U.S. PATENT DOCUMENTS

| | | | | |
|---|---|---|---|---|
| 580,148 | A * | 4/1897 | Staples | 38/95 |
| 590,347 | A * | 9/1897 | Sylvestre | 2/20 |
| 1,279,855 | A * | 9/1918 | Garvey | 2/168 |
| 1,416,001 | A * | 5/1922 | Detwiler | 2/21 |
| 1,990,553 | A * | 2/1935 | Hirsch et al. | 2/20 |
| 2,069,449 | A * | 2/1937 | Jensen | 2/20 |
| 2,881,022 | A * | 4/1959 | Brust | 294/25 |
| 3,181,198 | A * | 5/1965 | Stelzen | 452/103 |
| 3,975,043 | A * | 8/1976 | Miles | 294/25 |
| 4,032,990 | A | 7/1977 | Mandlman | |
| 4,188,055 | A * | 2/1980 | Green | 294/1.3 |
| 4,197,611 | A | 4/1980 | Bell et al. | |
| 4,682,803 | A * | 7/1987 | Andrews | 452/196 |
| 4,938,515 | A | 7/1990 | Fazio | |
| 5,867,867 | A | 2/1999 | Kessler | |
| 5,878,438 | A | 3/1999 | Ragsdale | |
| 5,878,439 | A | 3/1999 | Waters, Jr. | |
| 6,012,170 | A | 1/2000 | Kim | |
| 6,092,238 | A | 7/2000 | Fierabend, Jr. | |
| 6,112,372 | A | 9/2000 | Zhou et al. | |
| 6,216,276 | B1 | 4/2001 | Eibert | |
| 6,305,023 | B1 | 10/2001 | Barkes | |
| 6,367,081 | B1 | 4/2002 | Harris | |
| 6,532,597 | B1 * | 3/2003 | Bignon et al. | 2/161.6 |
| 6,553,576 | B1 | 4/2003 | Knapp | |
| 6,704,939 | B1 | 3/2004 | Faulconer | |
| 6,725,505 | B1 | 4/2004 | Willat | |
| 2003/0126669 | A1 * | 7/2003 | Bignon et al. | 2/169 |

FOREIGN PATENT DOCUMENTS

| | | |
|---|---|---|
| GB | 1 450 683 | 9/1976 |
| GB | 2 331 915 | 6/1999 |
| JP | 6101105 | 4/1994 |

* cited by examiner

*Primary Examiner*—Katherine M. Moran
(74) *Attorney, Agent, or Firm*—Jenkens & Gilchrist, P.C.

(57) ABSTRACT

A generally C-shaped body for hand protection and grip enhancement includes a finger receiving pocket at a first end of the body and a thumb receiving pocket at a second end of the body. The fingers of a user are placed in the finger receiving pocket, while the thumb is placed in the thumb receiving pocket. This causes the user's palm to rest on a convex hinge portion. The finger receiving pocket and the thumb receiving pocket helps the user bend the finger receiving pocket and the thumb receiving pocket for gripping objects.

29 Claims, 6 Drawing Sheets

SILICONE GRABBER

BACKGROUND OF THE INVENTION

1. Technical Field of the Invention

The present invention relates in general to hand protectors and grip enhancers and more specifically to pot and pan holders. In particular, the present invention relates to a C-shaped body which increases the ability of a user to grasp objects securely and protect the user's hand from heated surfaces.

2. Description of Related Art

The gripping of objects could be considered an important aspect of everyday life due to the simple fact that people use their hands to grip objects all the time during the course of the day. Oven mitts, pot holders, and dish holders are most commonly used for holding heated kitchen utensils used during cooking. Since oven mitts are usually large and clumsy, a user may find it difficult to securely grasp the object and further may need help from their other hand to put on the oven mitt. Pot holders do not cover the area to be held very well and can easily slip. Thus, the user's hand is susceptible to the heated utensils unless extra caution is exercised by the user while using oven mitts and pot holders. Hence, neither oven mitts nor pot holders provide a safe and convenient mechanism for handling cooking utensils.

Moreover, due to the conventional size and shape of oven mitts and pot holders, the oven mitts and pot holders themselves are at risk of getting burned when used for cooking purposes. In addition, the food in the cooking utensils may come in contact with the oven mitts and pot holders and become contaminated.

In another approach, gloves are frequently used to protect hands from heated surfaces and enhance gripping. Gloves used for such purposes may suffer from bunching of the material from which they are constructed, causing discomfort. In addition, gloves are prone to deterioration and can be unhygienic when used repeatedly. Furthermore, gloves must be sized to exactly fit the user's hand to provide the user with grip enhancing capabilities and protection from heat.

None of the prevalent prior art solutions provide an effective means for gripping and protecting a user's hand during cooking processes or other activities, especially in situations where the user needs to quickly lift a pot lid, move a pot from a stove, or hold a pot handle with one hand while performing other activities with their other hand.

Therefore, there is a need for a flexible heat resistant grip enhancer that is comfortable and easily bendable for gripping objects along with being simple and inexpensive to manufacture.

SUMMARY OF THE INVENTION

A gripping device useful for hand protection and grip improvement comprises a generally C-shaped body which includes a finger receiving pocket at a first end of the C-shaped body. The C-shaped body further includes a thumb receiving pocket at a second end of the C-shaped body. The finger receiving pocket and the thumb receiving pocket help a user bend the C-shaped body about a flex/hinge region to grip an object.

In an embodiment of the invention, the C-shaped body is symmetrical in size (and perhaps, shape) about the flex/hinge region, with the finger receiving pocket at the first end of the C-shaped body being a substantially mirror image of the thumb receiving pocket at the second end of the C-shaped body. Additionally, the shape of the finger receiving pocket and the thumb receiving pocket is substantially the same.

In an embodiment of the invention, the thumb receiving pocket further includes a thumb receiving stall extending from an inside wall of the C-shaped body to better surround an inserted user's thumb.

In yet another embodiment of the invention, the thumb receiving pocket is replaced by a thumb receiving stall extending from the C-shaped body.

In another embodiment of the invention, the finger receiving pocket and the thumb receiving pocket are replaced by a strap mechanism for receiving the fingers and thumb of a user's hand.

In yet another embodiment of the invention, the shape of the finger receiving pocket and the thumb receiving pocket is not similar.

In another embodiment of the invention, the flex/hinge region has a substantially flat outer surface shape.

In yet another embodiment of the invention, the C-shaped body is non-symmetrical in size (and perhaps, shape) about the flex/hinge region such that the length of the first end of the body extending from the flex/hinge region is not equal to the length of the second end of the body extending from the flex/hinge region.

BRIEF DESCRIPTION OF THE DRAWINGS

A more complete understanding of the method and apparatus of the present invention may be acquired by reference to the following Detailed Description when taken in conjunction with the accompanying Drawings wherein.

DETAILED DESCRIPTION OF THE DRAWINGS

Figure 1:
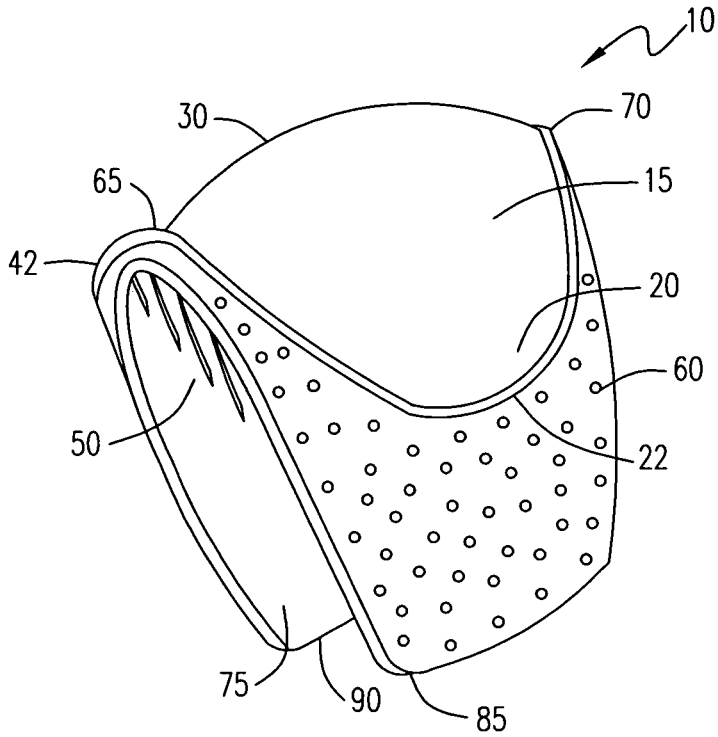
FIG. 1 is a perspective view of the C-shaped body according to the present invention.

With reference now to the drawings, and in particular to FIGS. 1–11 thereof, a novel hand protector and grip enhancer embodying the principles and concepts of the present invention and generally designated by the reference numeral 10 will be described. While the embodiments described herein are intended as an exemplary hand protector and grip enhancer during cooking, it will be appreciated by those skilled in the art that the present invention is not limited for cooking activities, and may include a variety of activities which benefit from grip enhancement such as opening jars, bottle caps etc.

Referring now to FIGS. 1–4, a first embodiment of the hand protector and grip enhancer of the present invention will be described in detail.

The hand protector and grip enhancer 10 includes a flexible body portion 15 having a substantially C-shaped cross-section. The hand protector and grip enhancer 10 is useful for enabling a user to better hold objects (such as kitchen utensils) while protecting their hand from heat. In general, the hand protector and grip enhancer 10 includes a first pocket 20 at a first end 85 of the body portion 15, a second pocket 40 at a second end 90 of the body portion 15, a hinge region 30 at the center of the C-shaped body 15, and ribs 50 at the interior of the C-shaped body.

In use, the first pocket 20 receives the fingers of a user, while the second pocket 40 receives the thumb of the user. For convenience, the first pocket 20 will be referred to as the finger receiving pocket, while the second pocket 40 will be referred to as the thumb receiving pocket. It is important to note that FIGS. 1–4 and the description herein are directed to a universal single hand protector and grip enhancer 10 wherein the hand protector and grip enhancer 10 can be worn interchangeably on the left and the right hand of the user. As such, the finger receiving pocket 20 and the thumb receiving pocket 40 are substantially similar and are interchangeable with respect to the user.

The finger receiving pocket 20 includes a first flap 22 which is integrally formed with the C-shaped body 15 to define the pocket area. This flap 22 extends from a first edge 65 to a second edge 70 of the first end 85 for covering the fingers of the user. Similarly, the thumb receiving pocket 40 includes a second flap 42 which is integrally formed with the C-shaped body 15 to define the pocket area. This flap 42 extends from the first edge 65 to the second edge 70 of the second end 90 for covering the thumb of the user. The flaps 22 and 42 are not only attached (integrally) at the edges 65 and 70, but are also integrally attached at the distal ends of the first and second ends 85 and 90. Accordingly, the C-shaped body 15 and flaps 22 and 42 are joined along the first and second edges 65 and 70 and distal ends 85 and 90 to form the finger receiving pocket 20 and thumb receiving pocket 40 of the hand protector and grip enhancer 10. The distal ends 85 and 90 have a substantially flat tip shape. The flat tip shape of the ends 85 and 90 enable the hand protector and grip enhancer 10 to free stand in an upright position.

The hand protector and grip enhancer 10 is flexible and can be made of various materials which are heat resistant and flame resistant to protect the user's hand while in contact with heated surfaces. In one embodiment of the present invention, the hand protector and grip enhancer 10 can be made of a material that is heat resistant, hygienic, easy to clean, e.g., silicone. Although the hand protector and grip enhancer 10 is disclosed as being formed of silicone, it will be appreciated that the hand protector and grip enhancer 10 according to the present invention can be formed from a variety of different materials (such as elastomers, rubbers and any other material that is flexible, heat resistant and/or flame resistant).

As further depicted in FIG. 1, the flaps 22 and 42 of the hand protector and grip enhancer 10 may optionally further include small holes 60 for the finger receiving pocket 20 and the thumb receiving pocket 40. These holes 60 are intended to permit air to reach a user's skin, thereby facilitating the evaporation of perspiration or other moisture.

Figure 2:
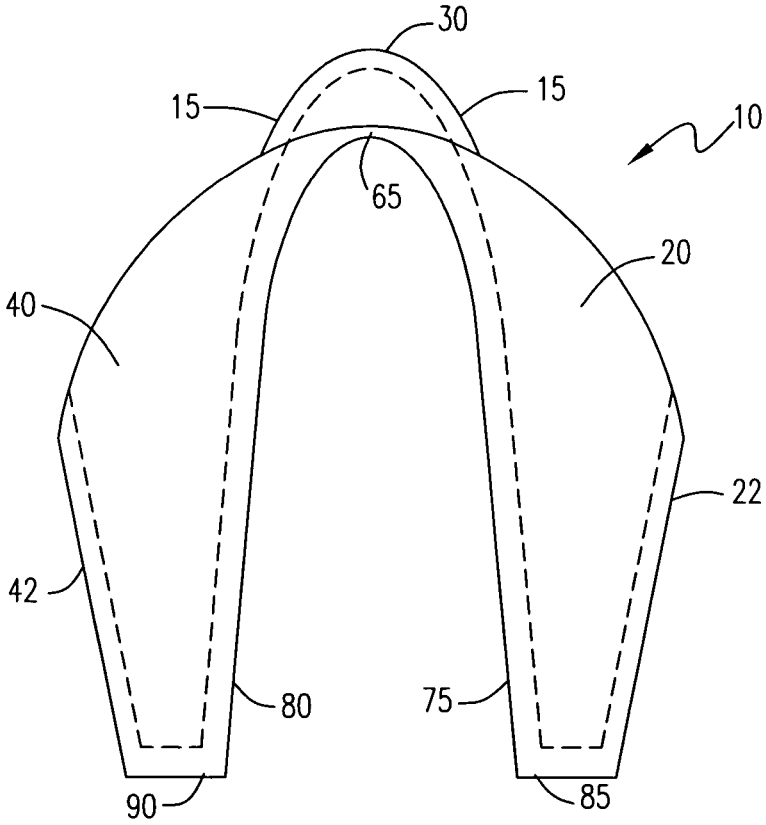
FIG. 2 is an end view of the C-shaped body in accordance with the present invention.

FIG. 2 illustrates an end view of the flexible hand protector and grip enhancer 10. The hinge region 30 is shaped to substantially conform to the user's palm when being used. More specifically, the hinge portion 30 has a substantially convex outer surface shape (visible as well in FIG. 1). The length of the C-shaped body 15 from the hinge region 30 towards the first end 85 along the finger receiving pocket 20 is sized to generally conform to a length of the user's hand from the palm of the user's hand towards the finger tips. Similarly, the length of the C-shaped body 15 from the hinge region 30 towards the second end 90 along the thumb receiving pocket 40 is sized to generally conform to a length of the user's hand from the palm of the user's hand towards the tip of the user's thumb. In an exemplary embodiment of the present invention, the length of the finger receiving pocket 20 extending from the hinge region 30 towards the first end 85 along the finger receiving pocket 20 is substantially similar to the length of the thumb receiving pocket 40 extending from the hinge region 30 towards the second end 90 along the thumb receiving pocket. In an exemplary embodiment, the shape of the first and second pockets is substantially the same.

FIG. 2 further illustrates the interior region of the hand protector and grip enhancer 10. A first wall 75 refers to the interior region of the C-shaped body 15 and runs along the side of the finger receiving pocket 20. A second wall 80 refers to the interior region of the C-shaped body 15 and runs along the side of the thumb receiving pocket 40. According to the present invention, the first and second walls present surfaces which are utilized for gripping purposes. Preferably, these surfaces are configured so as to assist in reducing slippage with respect to gripped objects. According to an embodiment of the present invention, grip enhancement is achieved by including a plurality of bumps and/or ridges on the surface of the first and second walls 75 and 80. In another embodiment, the surface of the first and second walls 75 and 80 include a plurality of protuberances having a shape which is adapted to minimize slippage. A detailed illustration of the interior region of the hand protector and grip enhancer 10 is shown with reference to FIG. 4. In another embodiment, the material with which the C-shaped body 15 is manufactured (for example, silicone) possesses an inherent anti-slip characteristic with respect to its surface.

With reference to FIG. 2, the manner of using the hand protector and grip enhancer 10 will now be described. The flat tip shape of the first end 85 and the second end 90 of the hand protector and grip enhancer 10 enables the hand protector and grip enhancer 10 to stand upright. This enables the user to slide the hand being used in the pockets 20 and 40 without any assistance from the other hand. Moreover, the hand protector and grip enhancer 10 can be picked up with one hand.

Assuming that the hand protector and grip enhancer 10 is worn on the left hand of the user, the fingers are placed in the finger receiving pocket 20, while the thumb is placed in the thumb receiving pocket 40. This causes the palm of the user to rest on the convex hinge portion 30. The finger receiving pocket 20 and the thumb receiving pocket 40 helps the user bend the finger receiving pocket 20 and the thumb receiving pocket 40 about the hinge region 30 for gripping. As such, objects can be effectively grasped and manipulated to perform various tasks. The hand protector and grip enhancer 10 is manufactured in various sizes to provide better fit to users.

Figure 3:
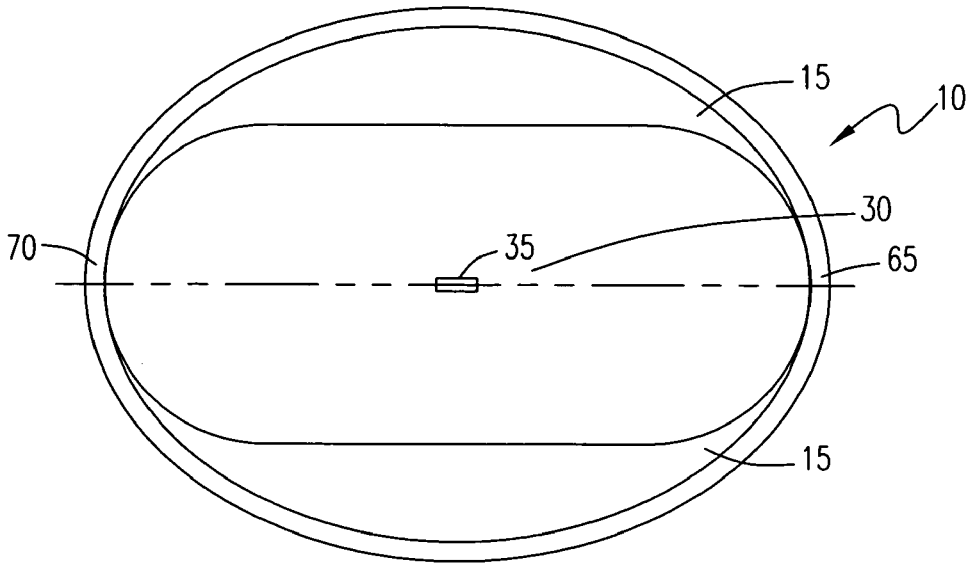
FIG. 3 is a top view of the C-shaped body in accordance with the present invention.

FIG. 3 illustrates a top view of the C-shaped body. FIG. 3 further illustrates a rectangular hole 35 towards the center of the hinge region 30. The rectangular hole 35 is utilized for a variety of purposes including air flow, drainage, display, etc.

Figure 4:
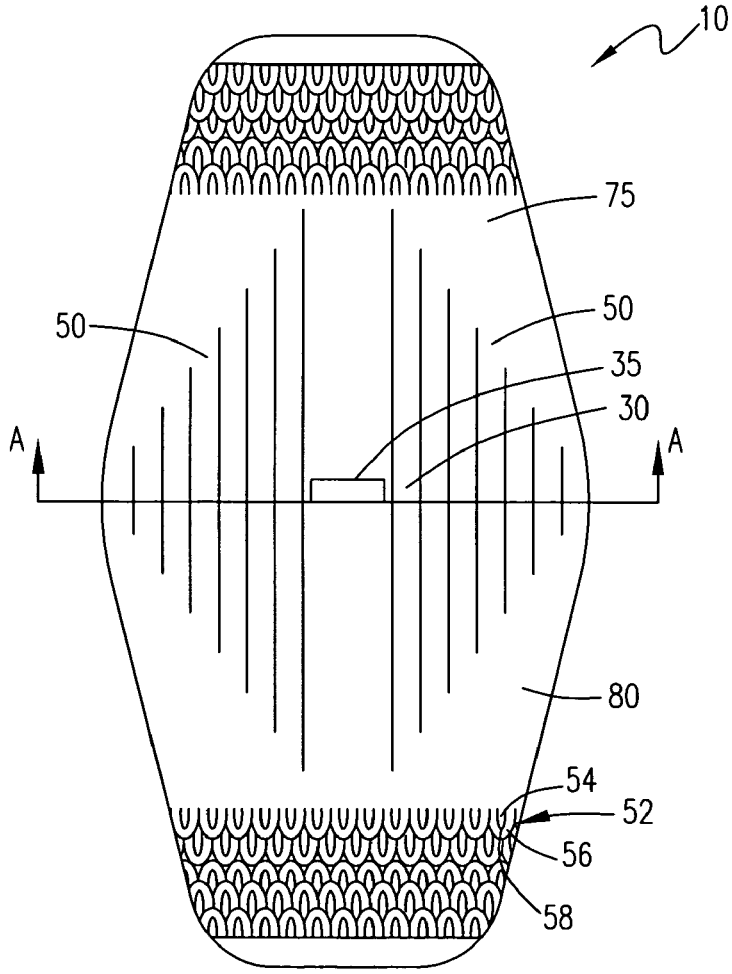
FIG. 4 illustrates a detailed view of the interior region of the C-shaped body.

FIG. 4 provides a detailed illustration of the interior region of the hand protector and grip enhancer 10. In this view, the hand protector and grip enhancer 10 has been opened up to some degree with respect to its natural C-shape. The interior region comprises ribs 50 that run along the first wall 75 and the second wall 80. The ribs 50 are substantially different in length, whereby the ribs 50 are longest towards the center of the C-shaped body and decrease in length towards the edges. The ribs 50 help define the natural C-shape of the hand protector and grip enhancer 10 by resisting opening of the body 15. Additionally, the ribs help distance the gripped object from the user's palm. The ribs 50 further assist in defining the shape of the convex hinge region 30.

FIG. 4 further illustrates an embodiment of the present invention in which the surface of the first and second walls 75 and 80 include a plurality of protuberances, wherein the protuberances are in the form of a "fish-scale" design. More particularly, the protuberances are in the form of semi-circles 52. The protuberances includes an upper surface 54 and a side portion 56 which forms an upper edge 58. The upper edge 56 of the protuberances is adapted to reduce slippage of the device when held by the user. As illustrated in FIG. 4, the protuberances can be oriented in different directions to reduce slippage in different directions. Although illustrated in FIG. 4 as being substantially semi-circular, it will be appreciated that the surface protuberances according to the present invention can take a variety of shapes. of a "fish-scale" design. More particularly, the protuberances are in the form of semi-circles. The protuberances includes an upper surface 54 and a side portion 56 which forms an upper edge 58. The upper edge 56 of the protuberances is adapted to reduce slippage of the device when held by the user. As illustrated in FIG. 4, the protuberances can be oriented in different directions to reduce slippage in different directions. Although illustrated in FIG. 4 as being substantially semi-circular, it will be appreciated that the surface protuberances according to the present invention can take a variety of shapes.

Figure 5:
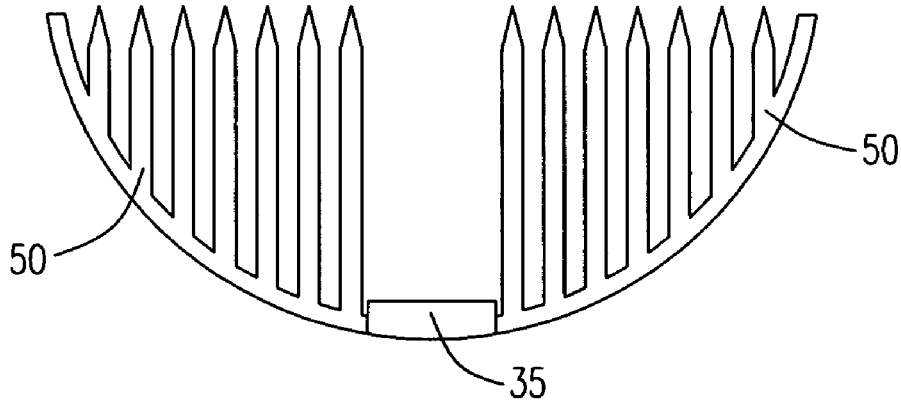
FIG. 5 illustrates a cross-sectional view taken along line A—A of FIG. 4.

FIG. 5 illustrates a cross-sectional view taken along line A—A of FIG. 4. In this view the cross section is taken of the hand protector and grip enhancer 10 along the hinge region 30. FIG. 5 provides a detailed illustration of the ribs 50. The ribs 50 are of different lengths, being shortest along the edges and gradually increasing in length towards the center of the C-shaped body 15. FIG. 5 further shows the convex shape of the hinge region 30 which conforms generally to the shape of the user's palm. The ribs 50 further are of different heights, being shortest along the edges and gradually increasing in height towards the center of the C-shaped body 15 so as to define the convex shaped hinge region 30.

Figure 6:
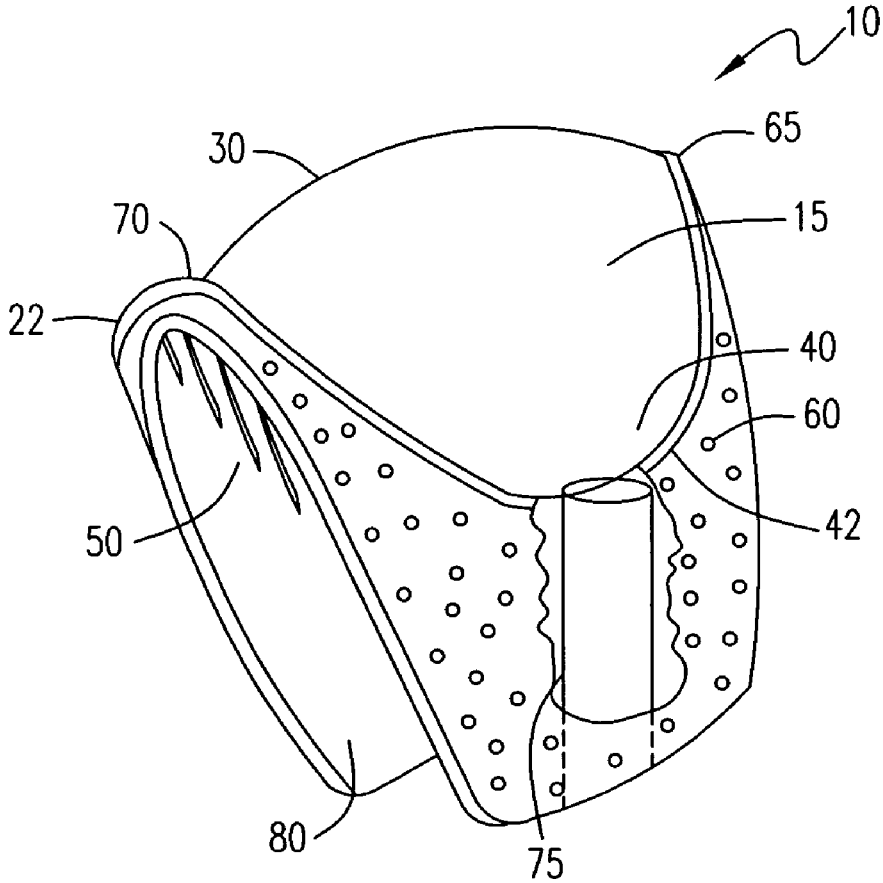
FIG. 6 is a perspective view of the C-shaped body according to an alternate embodiment of the present invention.

FIG. 6 illustrates an alternative embodiment of a hand protector and grip enhancer 10 according to the present invention. The hand protector and grip enhancer 10 is substantially similar to the one disclosed earlier with reference to FIGS. 1–4, however, the thumb receiving pocket 40 as disclosed in FIG. 6 further comprises a thumb receiving stall 75 integrally formed with the body to an inside wall of the C-shaped body 15 and is sized and shaped to cover the user's thumb. The thumb receiving stall 75 receives the user's thumb and provides comfort and stability to the user while performing various activities. The purpose of the thumb receiving stall 75 is to better retain the user's thumb and prevent the thumb from wandering in an opening which was sized to receive a plurality of fingers.

Figure 7:
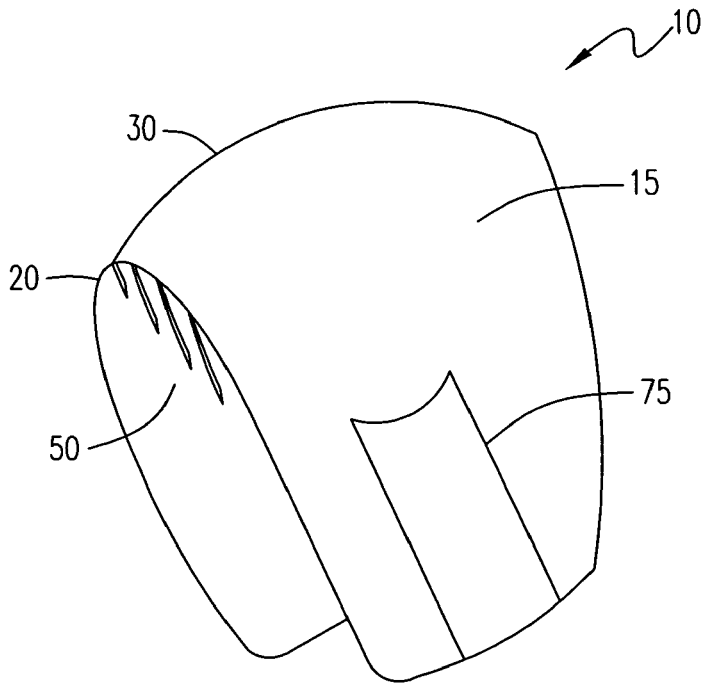
FIG. 7 is a perspective view of the C-shaped body according to another alternate embodiment of the present invention.

FIG. 7 illustrates an alternative embodiment of a hand protector and grip enhancer 10 according to the present invention. The hand protector and grip enhancer 10 is substantially similar to the one disclosed earlier with reference to FIGS. 1–4, however, the thumb receiving flap 42 for the thumb receiving pocket 40 as disclosed in FIGS. 1–4 is replaced by a thumb receiving stall 75. The thumb receiving stall 75 is integrally formed with a wall of the C-shaped body 15 and is sized and shaped to cover the user's thumb. The thumb receiving stall 75 receives the user's thumb and provides comfort and stability to the user while performing various activities. The purpose of the thumb receiving stall 75 is to better retain the user's thumb. The hand protector and grip enhancer 10 as disclosed in FIG. 7 is no longer interchangeable with respect to the user's thumb and fingers.

Figure 8:
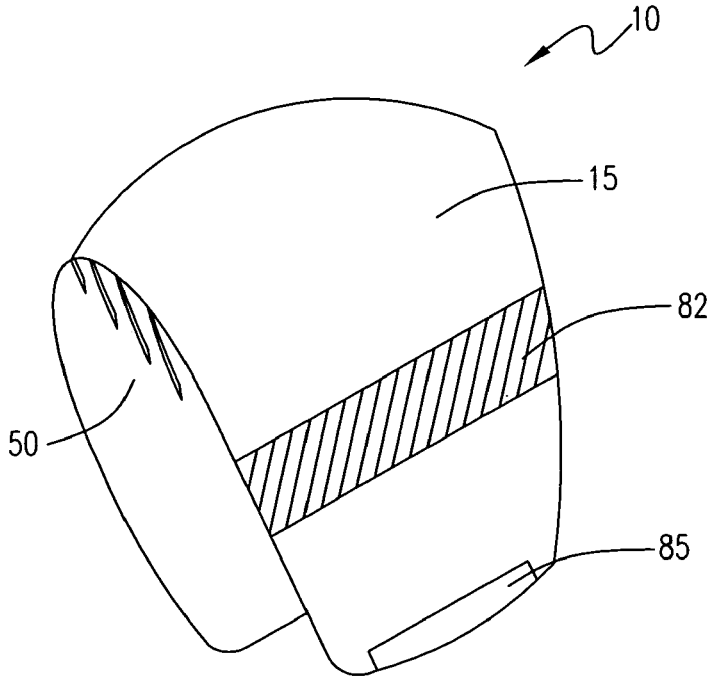
FIG. 8 is a perspective view of the C-shaped body according to yet another embodiment of the present invention.

FIG. 8 depicts yet an alternative embodiment of a hand protector and grip enhancer 10 according to the present invention. The hand protector and grip enhancer 10 is substantially similar to the ones disclosed earlier with reference to FIGS. 1–7. However, the hand protector and grip enhancer 10 of FIG. 8 comprises a strap mechanism 82 in place of the flaps 22 and 42 (FIG. 1). The strap mechanism 82 is used to receive a user's thumb and fingers instead of the thumb receiving pocket and the finger receiving pocket. The strap mechanism 82 may provide better flexibility and comfort to some users. FIG. 8 further illustrates a finger guard 85 attached to the end of the C-shaped body. The purpose of the finger guard 85 is to protect the finger tips from coming into contact with heated surfaces. The finger guard 85 has a substantially flat tip shape. The flat tip shape of the finger guard 85 enables the hand protector and grip enhancer 10 to free stand in an upright position. For easier illustration, only one side of the hand protector and grip enhancer 10 employing the strap mechanism 82 is shown. The hand protector and grip enhancer 10 as disclosed in FIG. 8 can be worn interchangeably on the left and the right hand of the user. As such, the finger receiving section and the thumb receiving section employing the strap mechanism 82 are substantially similar.

Figure 9A:
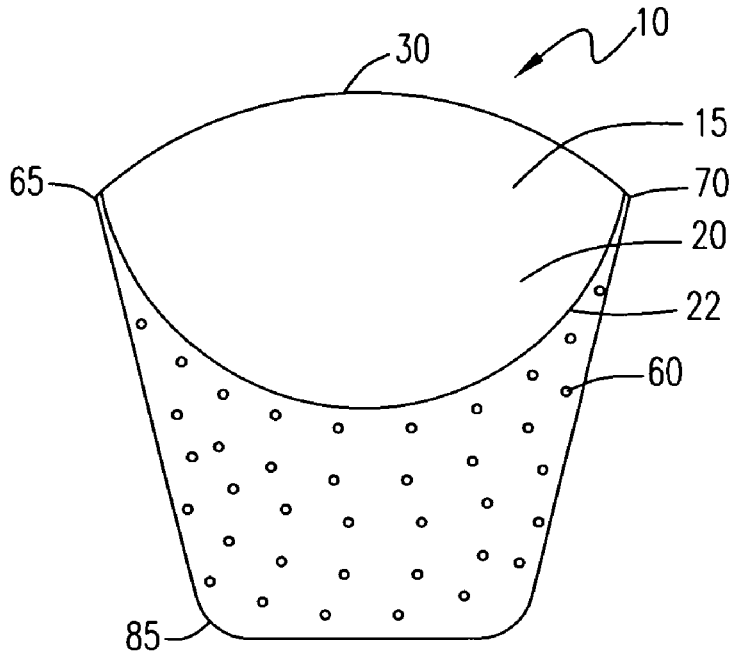
FIG. 9A illustrates an exemplary shape of the finger receiving pocket.
Figure 9B:
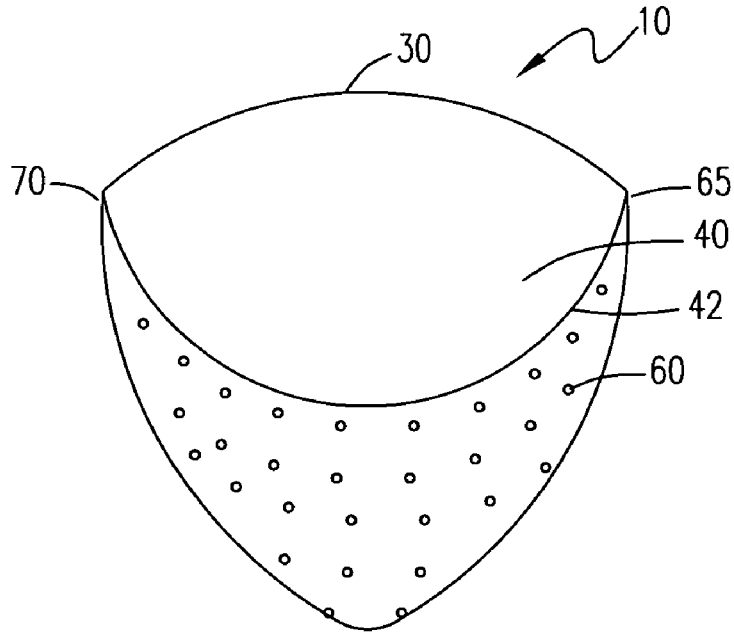
FIG. 9B illustrates an exemplary shape of the thumb receiving pocket.

FIGS. 9A and 9B illustrate an alternate embodiment of a hand protector and grip enhancer 10 according to the present invention. The hand protector and grip enhancer 10 is substantially similar to the ones disclosed earlier with reference to FIGS. 1–4. However, in this embodiment, the shape of the finger receiving pocket and the thumb receiving pocket is not similar. The shapes of the pockets can be altered to better accommodate the portion of the hand that the pocket receives. As such, a pocket receiving the user's fingers will be more spacious (in order to receive a plurality of fingers) than a pocket receiving the user's thumb. FIG. 9A illustrates an exemplary shape of a finger receiving pocket, while FIG. 9B illustrates an exemplary shape of a thumb receiving pocket. The purpose of having different shapes for pockets is to better retain the user's fingers and thumb.

Figure 10:
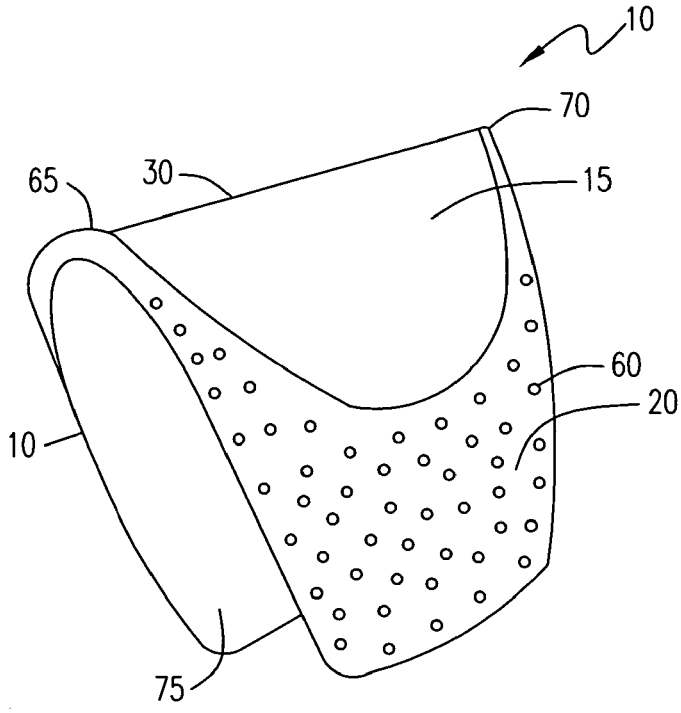
FIG. 10 is a perspective view of the C-shaped body according to another embodiment of the present invention.

FIG. 10 depicts yet another alternate embodiment of a hand protector and grip enhancer 10 according to the present invention. The hand protector and grip enhancer 10 is substantially similar to the one disclosed earlier to the one disclosed earlier with reference to FIGS. 1–4. As illustrated in FIG. 10, in an exemplary embodiment of the present invention, the hinge region 30 at the center of the body 15 has a substantially flat outer surface shape. Additionally, the interior region of the hand protector and grip enhancer 10 does not include ribs 50. The absence of ribs 50 at the interior region of the body 15 prevents the hand protector and grip enhancer 10 from having a substantially C-shaped cross-section. This enables the hand protector and grip enhancer 10 to be fully opened and lay flat and may be useful for some users in performing certain functions.

Figure 11:
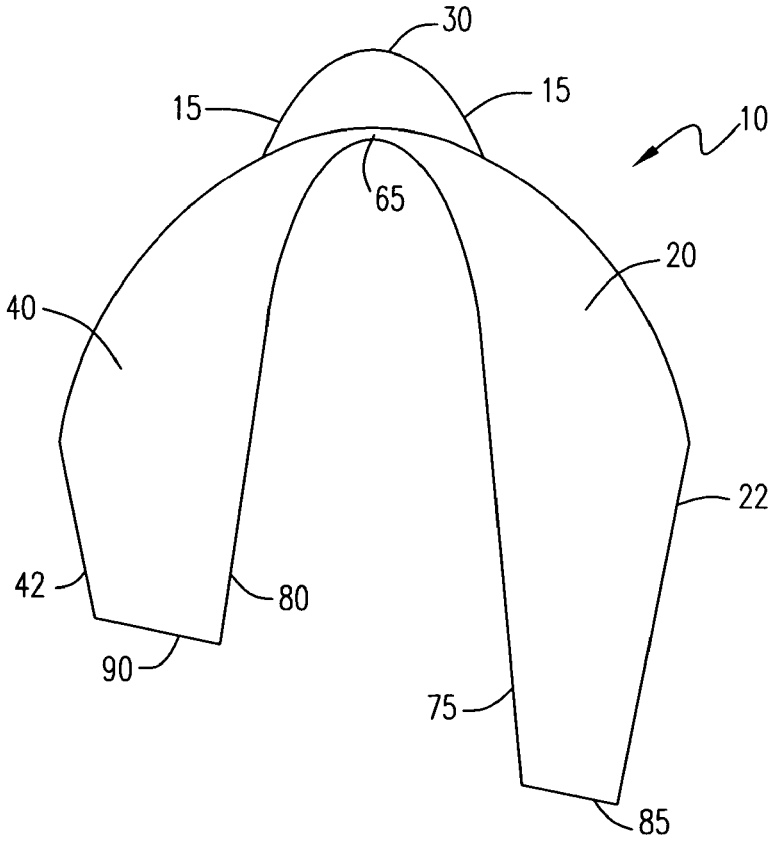
FIG. 11 is a side view of the C-shaped body according to yet another alternate embodiment of the present invention.

FIG. 11 depicts an alternative embodiment of a hand protector and grip enhancer 10 according to the present invention. The hand protector and grip enhancer 10 as disclosed in FIG. 10 is substantially similar to the one disclosed earlier with reference to FIGS. 1–4. As illustrated in FIG. 11, in an exemplary embodiment of the present invention, the length of the finger receiving pocket 20 extending from the hinge region 30 towards the first end 85 is not equal to the length of the thumb receiving pocket 40 extending from the hinge region 30 the second end 90. More particularly, the length along the thumb end is shorter than the length along the finger end. This configuration may provide more convenient means for some users in performing certain functions. It will be understood that any of the embodiments of FIGS. 6–10 may include unequal length ends of the C-shaped body 15.

Although preferred embodiments of the method and apparatus of the present invention have been illustrated in the accompanying Drawings and described in the foregoing Detailed Description, it will be understood that the invention is not limited to the embodiments disclosed, but is capable of numerous rearrangements, modifications and substitutions without departing from the spirit of the invention as set forth and defined by the following claims.

What is claimed is:

1. A hand protector and grip enhancer, comprising:

a generally C-shaped body defining an interior region including a plurality of ribs that bridge across a hinge region and extend generally perpendicularly from the hinge region towards a first end and a second end of the C-shaped body;

a finger receiving pocket at said first end of said C-shaped body;

a thumb receiving pocket at said second end of said C-shaped body;

wherein said C-shaped body is flexible about said hinge region between said first and second ends; and wherein said C-shaped body is symmetrical about said hinge region.

2. The hand protector and grip enhancer of claim 1, wherein said C-shaped body is made of a material having low thermal conductivity.

3. The hand protector and grip enhancer of claim 2, wherein said material possesses an inherent anti-slip characteristic.

4. The hand protector and grip enhancer of claim 1, wherein said C-shaped body is heat resistant.

5. The hand protector and grip enhancer of claim 4, wherein said C-shaped body is formed from silicone.

6. The hand protector and grip enhancer of claim 4, wherein said C-shaped body comprises at least one of elastomeric material and rubber.

7. The hand protector and grip enhancer of claim 1, wherein said hinge region is shaped to substantially conform to a user's palm.

8. The hand protector and grip enhancer of claim 1, wherein said hinge region has a substantially convex outer surface shape.

9. The hand protector and grip enhancer of claim 8, wherein said plurality of ribs define said convex outer surface shape of said hinge region.

10. The hand protector and grip enhancer of claim 1, wherein said hinge region has a substantially flat outer surface shape.

11. The hand protector and grip enhancer of claim 1, wherein a length of said C-shaped body from said hinge region to said first end is sized to generally conform to a length of a user's hand from a palm region to finger tips.

12. The hand protector and grip enhancer of claim 1, wherein said finger receiving pocket and said thumb receiving pocket includes holes to permit air flow and drainage.

13. The hand protector and grip enhancer of claim 1, wherein said each pocket includes a flap.

14. The hand protector and grip enhancer of claim 13, wherein said flap is integrally formed with said C-shaped body.

15. The hand protector and grip enhancer of claim 1, wherein said plurality of ribs run along a first wall and a second wall extending from said hinge region.

16. The hand protector and grip enhancer of claim 15, wherein at least two of said plurality of ribs are of different lengths.

17. The hand protector and grip enhancer of claim 15, wherein a surface of said first and second wall comprises a plurality of bumps and ridges.

18. The hand protector and grip enhancer of claim 17, wherein said surface of said first and second wall further comprises a plurality of discrete protuberances.

19. The hand protector and grip enhancer of claim 1, wherein said thumb receiving pocket further comprises a thumb receiving stall.

20. The hand protector and grip enhancer of claim 1, wherein said C-shaped body further comprises a strap mechanism wherein at least one said pocket is defined by a strap.

21. The hand protector and grip enhancer of claim 20, wherein said C-shaped body further comprises finger guards attached to said first and second ends of said C-shaped body.

22. The hand protector and grip enhancer of claim 1, wherein said finger receiving pocket and said thumb receiving pockets are substantially similar in shape.

23. The hand protector and grip enhancer of claim 1, wherein said first and second ends have a substantially flat tip shape.

24. The hand protector and grip enhancer of claim 23, wherein the substantially flat tip shape of said first and second ends enable said hand protector and grip enhancer to free stand in an upright position.

25. The hand protector and grip enhancer of claim 1, wherein said interior region possesses a grip enhancing surface extending at least partially along a first interior wall and a second interior wall from said hinge region.

26. The hand protector and grip enhancer of claim 25, wherein a surface of said first and second interior wall comprises a plurality of bumps.

27. A hand protector and grip enhancer, comprising:

a generally C-shaped body defining an interior region including a plurality of ribs that bridge across a hinge region and extend generally perpendicularly from the hinge region towards a first end and a second end of the C-shaped body;

a finger receiving pocket at said first end of said C-shaped body;

a thumb receiving pocket at said second end of said C-shaped body;

wherein said C-shaped body is flexible about said hinge region between said first and second ends; and wherein a length of said finger receiving pocket extending from said hinge region to said first end is substantially similar to a length of said thumb receiving pocket extending from said hinge region to said second end.

28. A hand protector and grip enhancer, comprising:

a generally C-shaped body;

a finger receiving pocket at a first end of said C-shaped body;

a thumb receiving pocket at a second end of said C-shaped body;

a hinge region towards a center of said C-shaped body, wherein a length of said finger receiving pocket extending from said hinge region to said first end is not substantially similar to a length of said thumb receiving pocket extending from said hinge region to said second end;

wherein said generally C-shaped body defines an interior region having a plurality ribs that bridge across said hinge region and extends generally perpendicularly from said hinge region towards said first and second ends of said C-shaped body; and wherein at least two of said plurality of ribs are of different lengths.

29. A hand protector and grip enhancer, comprising:

a generally C-shaped body defining an interior region including a plurality of ribs that bridge across a hinge region and extend generally perpendicularly from said hinge region towards a first end and a second end of the C-shaped body;

a finger receiving pocket at said first end of said C-shaped body;

a thumb receiving pocket at said second end of said C-shaped body; and wherein said plurality of ribs increase in length and height towards a center of said hinge region of said C-shaped body.

* * * * *